US007040637B2

(12) United States Patent
Owens et al.

(10) Patent No.: US 7,040,637 B2
(45) Date of Patent: May 9, 2006

(54) INWARDLY FOLDING ROLLATOR WITH AN UPWARDLY PIVOTABLE SEAT

(75) Inventors: John Owens, Sheffield, OH (US); Robert R. Bly, Wellington, OH (US); Kevin S. Wysocki, Grafton, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/977,122

(22) Filed: Oct. 12, 2001

(65) Prior Publication Data

US 2003/0070702 A1 Apr. 17, 2003

(51) Int. Cl.
*A61H 3/00* (2006.01)

(52) U.S. Cl. ..... 280/87.021; 280/87.05; 135/67; 135/85

(58) Field of Classification Search ..... 280/47.34, 280/87.021, 87.05, 639, 642, 647, 87.041; 135/65, 67, 69, 74, 85; 297/5, 6, 183.1
See application file for complete search history.

(56) References Cited

U.S. PATENT DOCUMENTS

| | | | | |
|---|---|---|---|---|
| 1,448,783 | A | 3/1923 | Blewitt et al. | |
| 2,685,325 | A * | 8/1954 | Webster | 297/30 |
| 2,798,533 | A * | 7/1957 | Frank | 297/6 |
| 2,866,495 | A | 12/1958 | Diehl et al. | |
| 3,159,428 | A * | 12/1964 | Schier | 297/452.65 |
| 3,354,893 | A * | 11/1967 | Schmerl | 135/67 |
| 3,462,195 | A * | 8/1969 | Allen | 297/452.1 |
| 4,046,374 | A | 9/1977 | Breyley | |
| 4,438,603 | A * | 3/1984 | Durkan, Jr. | 52/8 |
| 4,461,471 | A * | 7/1984 | Brastow | 482/68 |
| 4,518,002 | A | 5/1985 | Battiston et al. | |
| 4,619,282 | A | 10/1986 | Battison | |
| 4,640,301 | A | 2/1987 | Battiston et al. | |
| 4,643,211 | A | 2/1987 | Morris et al. | |
| 4,733,910 | A * | 3/1988 | Brennan | 297/285 |
| 4,907,794 | A | 3/1990 | Rose | |
| D310,646 | S | 9/1990 | Rose | |
| 5,020,560 | A | 6/1991 | Turbeville | |
| 5,172,715 | A | 12/1992 | Webb | |
| 5,201,333 | A | 4/1993 | Shalmon et al. | |
| 5,224,717 | A | 7/1993 | Lowen | |
| 5,224,721 | A | 7/1993 | Santmann | |
| 5,271,422 | A | 12/1993 | Sorrell et al. | |
| 5,275,187 | A | 1/1994 | Davis | |
| D344,917 | S * | 3/1994 | Kjell et al. | D12/130 |
| 5,320,122 | A | 6/1994 | Jacobson, II et al. | |
| 5,353,824 | A * | 10/1994 | Woods et al. | 135/66 |
| 5,419,571 | A | 5/1995 | Vaughan | |

(Continued)

OTHER PUBLICATIONS

Walking Aids by Invacare, Catalog, 1974.

(Continued)

*Primary Examiner*—Christopher P. Ellis
*Assistant Examiner*—Christopher Bottorff
(74) *Attorney, Agent, or Firm*—Calfee, Halter & Griswold LLP

(57) ABSTRACT

A rollator with a tubular frame assembly includes a pair of U-shaped side frames connected by a front brace. Each side frame has a cross bar that extends between front legs and back legs of the frame. The side frames are pivotably attached to the front brace so that the side frames can fold inwardly. The rollator has a molded rigid seat that is mounted on pivot brackets to allow it to pivot upwardly out of the way of the user. The pivot brackets have an offset axis of rotation so that the seat is arranged in a curved area of the front brace when pivoted upwardly.

75 Claims, 4 Drawing Sheets

U.S. PATENT DOCUMENTS

| | | | | |
|---|---|---|---|---|
| 5,433,235 | A | 7/1995 | Miric et al. | |
| 5,451,193 | A | 9/1995 | Pickard | |
| 5,529,425 | A * | 6/1996 | Spies et al. | 403/322.4 |
| 5,558,358 | A * | 9/1996 | Johnson | 280/648 |
| 5,579,793 | A | 12/1996 | Gajewski et al. | |
| 5,603,517 | A | 2/1997 | Lorman | |
| 5,772,234 | A * | 6/1998 | Luo | 280/642 |
| 5,862,825 | A | 1/1999 | Leonard | |
| 5,882,067 | A | 3/1999 | Carbajal et al. | |
| 5,887,887 | A * | 3/1999 | Keuning | 280/641 |
| 5,904,168 | A * | 5/1999 | Alulyan | 135/65 |
| 5,979,476 | A * | 11/1999 | Cranny | 135/67 |
| 6,099,002 | A | 8/2000 | Uchiyama | |
| 6,338,355 | B1 | 1/2002 | Cheng | |
| 6,338,493 | B1 * | 1/2002 | Wohlgemuth et al. | 280/30 |
| 6,371,142 | B1 * | 4/2002 | Battiston | 135/67 |
| 6,481,730 | B1 * | 11/2002 | Sung | 280/87.05 |
| 6,494,469 | B1 * | 12/2002 | Hara et al. | 280/87.041 |
| 6,659,478 | B1 * | 12/2003 | Hallgrimsson et al. | 280/47.36 |

OTHER PUBLICATIONS

Invacare Personal Care Products, Catalog, 2001.
2002 Eagle Health New Products, Catalog.
Folding Walkers, Catalog, undated.
Drive Medical Design and Manufacturing Products Catalog, undated.
Pro Basics Ambulatory Aids, www.pmiusa.biz/html_files/ambulatory.html, Sep. 23, 2003.
New Walkers and Accessories, Invacare, Catalog, Mar. 29, 1994.
More Great Options From Invacare, Catalog, 1994.
Invacare Ambulatory, Feb. 1996.
New Walkers and Accessories, Invacare, Catalog, Oct. 1, 1994.
Action Lifestyles by Invacvare, Catalog, 1991.
Invacare Personal Care Products, Catalog, 2000.
Guardian Walking Aids, Catalog, 2001.
Durable Medical Equipment, Catalog, 2001.
Walking Aids from Medline, Catalog, 2003.
Medical Depot Inc., products catalog, 2001.

* cited by examiner

INWARDLY FOLDING ROLLATOR WITH AN UPWARDLY PIVOTABLE SEAT

The invention relates generally to wheeled ambulatory supports, and more particularly to a rollator having a molded rigid seat to allow the user to rest in a stationary position but which can be pivoted upward out of the way of the user. Further, the side frame members can be folded inwardly in order to conserve storage space.

BACKGROUND OF THE INVENTION

Certain health conditions hinder vertical balance, and movement in the upright position or other mechanics of walking. The health care industry has developed aids for those who suffer from such conditions, including crutches, walkers, rollators, and wheelchairs. Rollators are wheeled supports which aid individuals who have function in their lower limbs, but lack the muscular control, strength or balance to enable them to walk unassisted. It is advantageous for such supports to include two pairs of wheels in order to avoid the need to lift the device, and to facilitate its use as an ambulatory aid. Further, these devices may include a seat so that a user may use the device to sit and rest.

Traditional walkers or rollators have a frame that forms a U-shaped enclosure about the user. The enclosure is open to the back and the user walks toward the closed front portion of the frame while using the lateral side armrests for support. Walkers typically do not include a seat, although rollators may include a seat. If a rollator includes a seat, the user turns to face the open side and sits facing the opposite direction from the orientation when the support is in active ambulatory use.

SUMMARY OF THE INVENTION

The rollator of the present invention has a frame comprised of opposing side frames linked by a front brace. The side frames each include tubular front and back leg members, each carried on a wheel, and joined at the top by an integral horizontal lateral support. Each lateral support generally includes an armrest and brake means. For each side frame, a cross bar extends between the front and back legs to support the construct, and to provide a mounting bar for the seat which is pivotably mounted to the front legs on a pair of mounting brackets which offset the axis of rotation forward of the front legs. This arrangement allows the seat to be flipped upward to open the space in the walker and such that the seat is out of the way of the user. The rear of the seat has integrally molded bracket members that are curved to minimize interference with the user and with the inwardly folding brake handles.

The frame also includes a front brace that has a bushing member on either side to rotatably hold the front legs of each of the side frame members. The legs include spring loaded locking members that cooperative with a locking recess in an annular catch plate to secure the side frames in the open position. The locking members can be released by pressing a lock handle and unlock the detent from the catch plate and to allow the side frames to be folded inward when the seat is in the upright position. The length of the front and back legs can be adjusted through a connection to telescoping length adjusting sleeves which are sure by snap buttons. This feature allows a simultaneous adjustment of the height of the seat, and of the armrests. The seat is preferably a contoured rigid, molded seat that includes a means to attach it to a pivot bracket on each side having a forward offset pivot axis. The brackets are carried on each of the front legs. The rear of the seat includes on each side a curved integral molded support bracket with a catching groove that hugs the cross bar to support the rear of the seat. The references to the location of the components, such as front and back, are in reference to the device when the user is facing the front brace in an upright walking position.

DETAILED DESCRIPTION OF THE INVENTION

Figure 1:
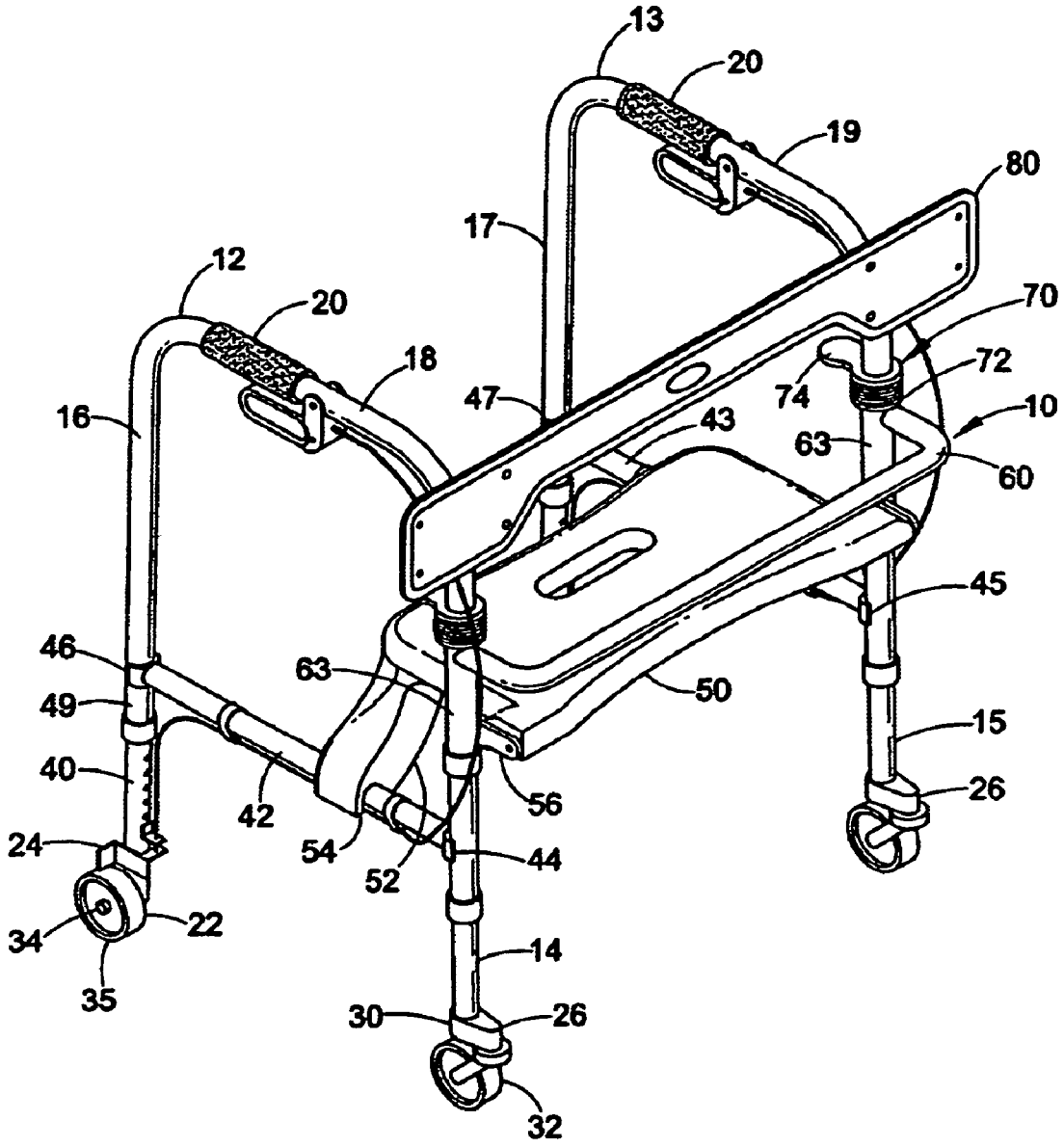
FIG. 1 is a front elevation of the rollator in an open position in accordance with the present invention.
Figure 2:
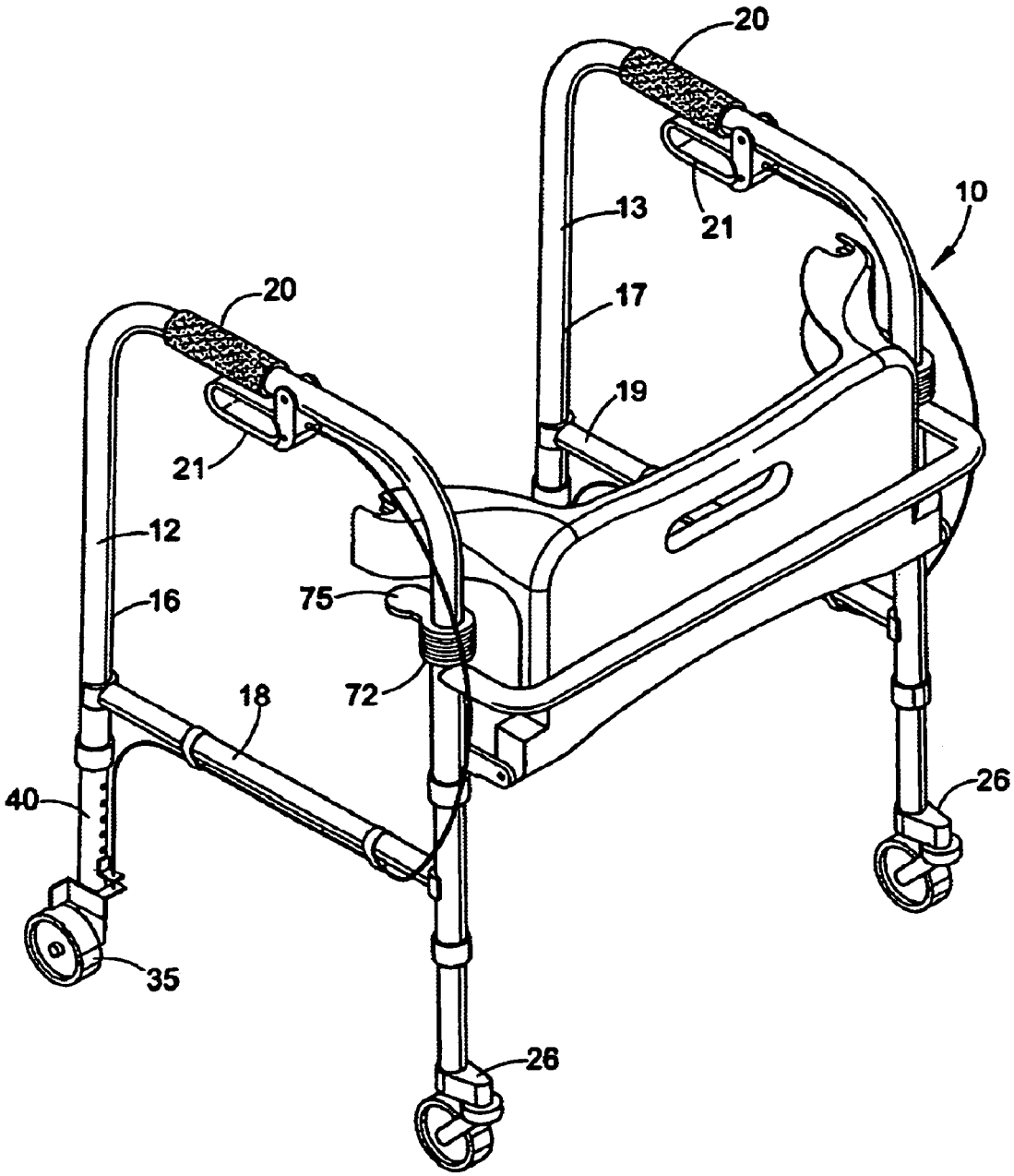
FIG. 2 is a front elevation of the rollator shown in FIG. 1 with the seat in the upright position.
Figure 3:
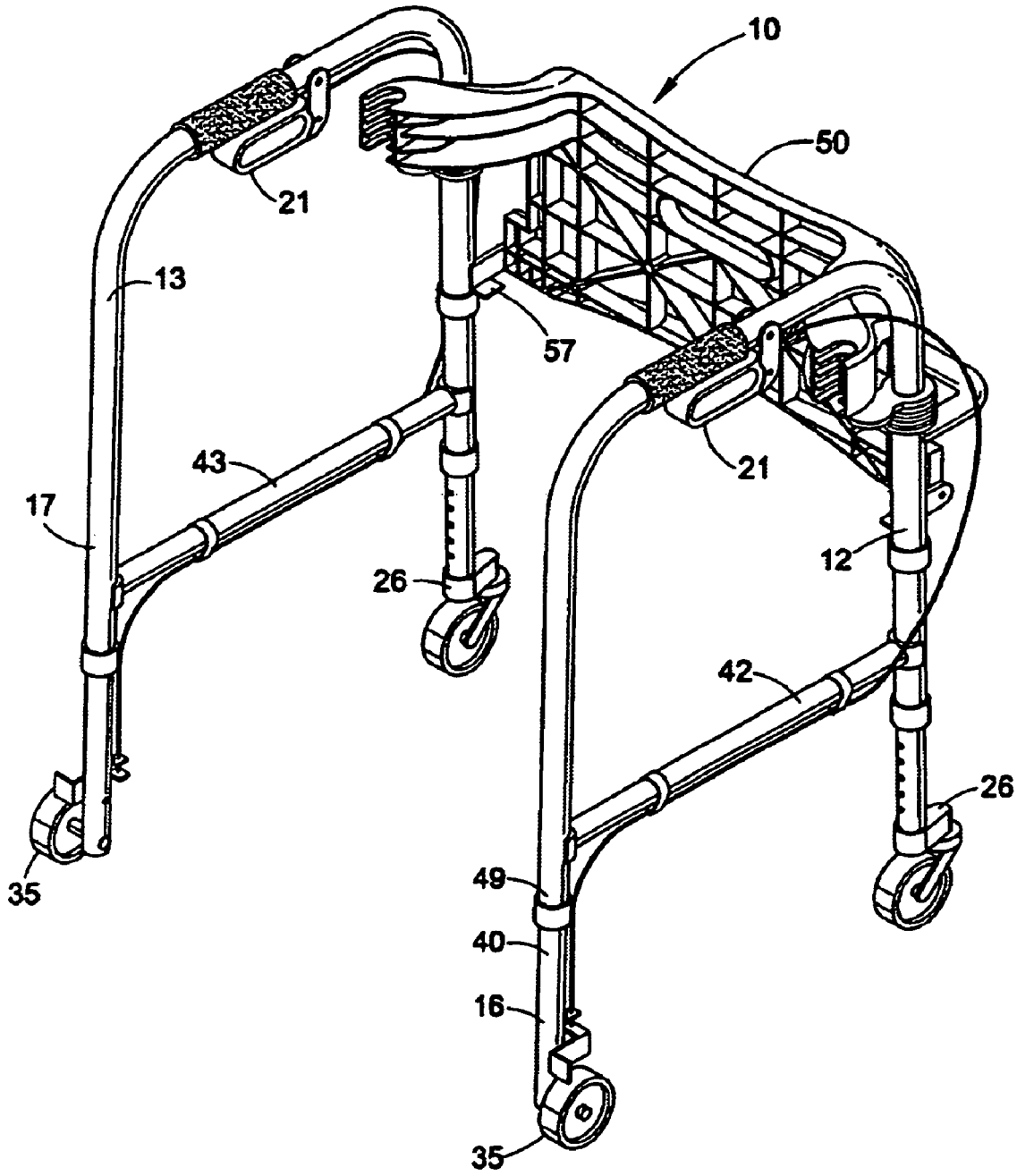
FIG. 3 is a rear elevation of the rollator shown in FIG. 1 with the seat in the upright position.
Figure 4:
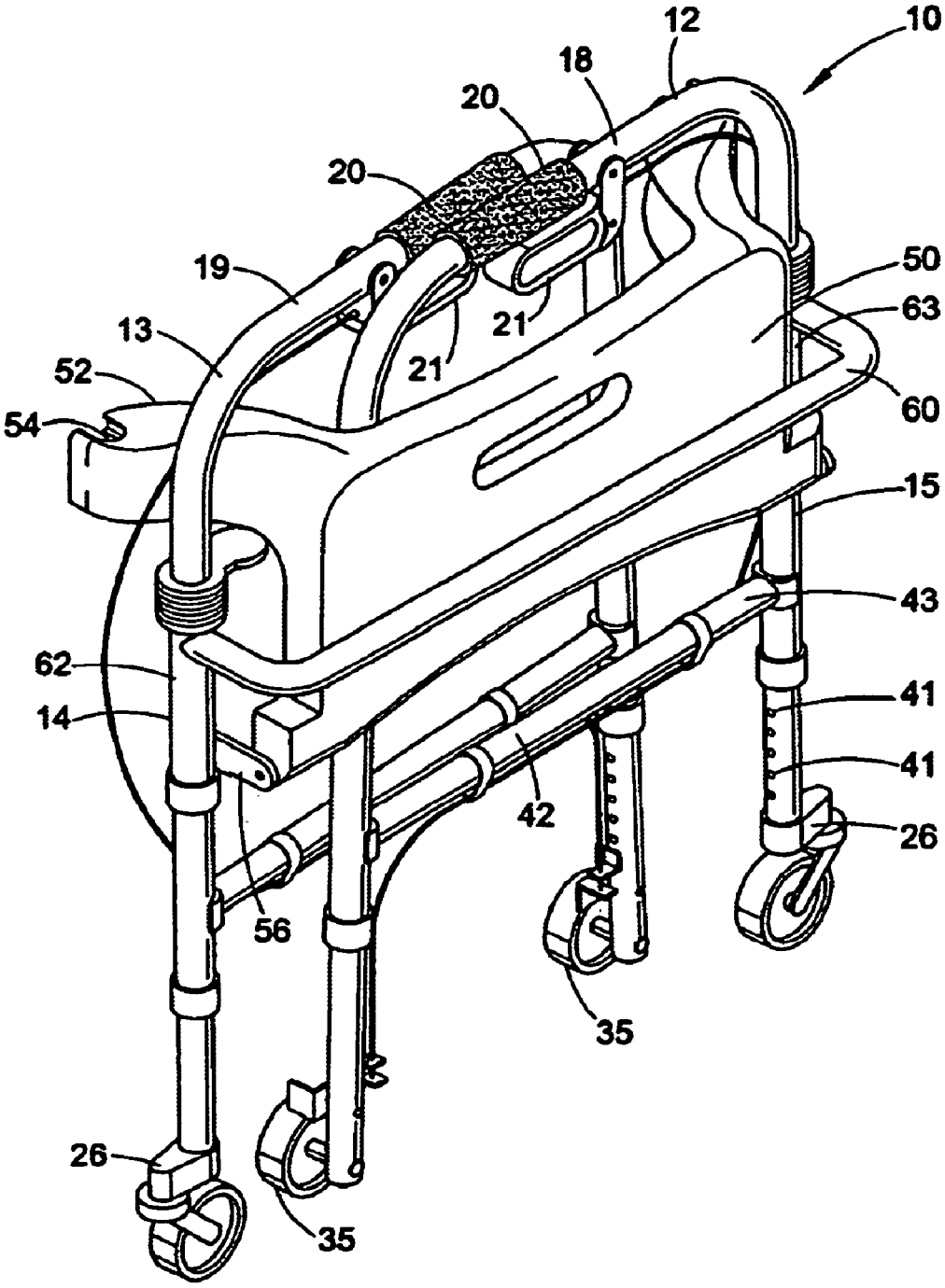
FIG. 4 is a front elevation of the rollator shown in FIG. 1 with the rollator folded inwardly.

The wheeled ambulatory support, or rollator of the present invention has a foldable frame 10 having a pair of generally U-shaped vertical side frames 12, 13 which are typically of a hollow tubular steel construction. The side frames 12, 13 each include a front leg 14, 15 and a back leg 16, 17. These front and back legs are each supported at the bottom by a wheel and at the top have an integral transverse horizontal support member 18, 19. These supports are positioned to carry armrests 20 upon which the user leans during ambulation. The supports 18, 19 also include a brake handle 21 which is used to activate a braking mechanism, typically connected by a cable to a brake shoe 24 which acts on the rear wheels 22. The rollator may also include an additional parking brake (not shown).

The front legs 14, 15 are each supported by offset castor forks 26 having a sleeve 30 that receives the bottom of the front leg and further having a front wheel 32. The back legs simply have an axle 34 of a wheel 35 that engages a bore in the rear leg to support the rear leg. A telescoping sleeve member 40 having spaced openings 41 receives a top portion 49 of the rear leg in a sliding cooperation and a spring biased pop detent or snap button snaps into place in the openings 41 to adjust the height of the rear leg. There is a corresponding mechanism for the front leg.

The side frames 12, 13 also each include a cross bar 42, 43 which have a bracket at either end 44, 45 and 46, 47 to secure the cross bar generally perpendicular to the front legs and the rear legs respectively. The cross bars form a support for the rearward-facing portion of the seat member 50. The seat member is a rigid molded plastic seat which may be contoured with a rear depression and forward pommel (i.e. relative to the seat) for comfort and that has integral downward curving rear brackets 52 that include u-shaped recesses 54 that form a frictional fit on the cross bar. The recesses are popped off of the cross bars to allow the seat to be folded upward about the front pivot brackets 56 that are mounted on either side of the front legs. The pivot brackets extend forward of the front legs so as to offset the axis of rotation forward of the front legs, e.g., by the depth of the seat. This puts the seat out of the way of the user when it is in the upright position. Additional support is provided by support flanges 57 that extend inwardly from the side frames and engages and support the bottom of the seat. The brackets 52 are curved to avoid interference with the brake handles 21 during folding.

The frame also includes a front brace 60 which comprises a curved tubular member having transverse bushings on either side 62, 63. The curve allows the seat to nest in front of the front brace 60 when the seat is upright. The front legs 14, 15 extend through and can rotate in the bushings to permit the side frames to be collapsed inward. Each side frame also includes a locking mechanism 70 that comprises an annular catch plate 72 having a lock hole that is engaged by a spring biased détente. A handle 75 is used to disengage the lock means 74. A flexible back support 80 which can be made from a suitable fabric strip which is riveted to itself also extends between the side frames.

While in accordance with the patent statutes the best mode and preferred embodiment have been set forth, the scope of the invention is not limited thereto, but rather by the scope of the attached claims.

What is claimed is:

1. An ambulatory device comprising:

(a) two side frames, each side frame including a front and back leg;

(b) a brace connecting the front leg of each of said frames; and (c) a seat having front and rear sections, the front section pivotably mounted to said frames, wherein said seat can be pivoted into at least two positions:

a first position having a substantially horizontal orientation; and a second position having a substantially vertical orientation;

(d) two support brackets disposed to secure said seat to said frames when said seat is in said first position; wherein said support brackets comprise a top surface and one or more flanges extending substantially along said top surface, and the support brackets provide support for the ambulatory device when said seat is in said first position such that when lateral force is applied to the side frames, the lateral force is distributed along the support brackets and across said seat;

wherein the support brackets further comprise one or more notches located in the one or more flanges, and wherein said seat further comprises a substantially flat sitting surface and an under-surface comprising a plurality of walled recesses.

2. The ambulatory device of claim 1 further comprising:

(a) a set of brakes positioned to engage one or more wheels on the back legs when a brake force is applied; and (b) at least one hand brake actuator positioned on at least one of said side frames, wherein said hand brake actuator is used to effectuate the brake force.

3. The ambulatory device of claim 1 further comprising a back rest connecting said side frames.

4. The ambulatory device of claim 1, further including at least one padded region located on at least one of said side frames.

5. The ambulatory device of claim 1, wherein said brace is curved outwardly away from said front legs.

6. The ambulatory device of claim 1, further comprising a locking mechanism, wherein at least one of said side frames can pivot approximately 180 degrees when said locking mechanism is released.

7. The ambulatory device of claim 1, further comprising a wheel connected to each of said front and back legs.

8. The ambulatory device of claim 1, wherein said side frames include a substantially u-shaped horizontal support member connecting said legs.

9. The ambulatory device of claim 1, wherein said side frames also include a cross-member which connects the mid-section of said legs.

10. The ambulatory device of claim 9, wherein said support brackets secure said seat to said cross-members.

11. The ambulatory device of claim 1, wherein each of said front and back legs includes a height adjustment mechanism.

12. The ambulatory device of claim 1 further comprising a locking mechanism located on each of said side frames, said locking mechanism maintaining said side frames spaced apart and releasable to allow said side frames to pivot inwardly toward the seat when said seat is in said second position.

13. The ambulatory device of claim 1, wherein said seat in said second position is at least partially in front of said front legs.

14. The ambulatory device of claim 1, wherein said seat includes a handle.

15. The ambulatory device of claim 1 wherein said plurality of walled-recesses comprise at least one walled recess having an open side.

16. The ambulatory device of claim 1, wherein said plurality of walled recesses comprise at least one walled recess having a partially open side.

17. The ambulatory device of claim 1, wherein said notches are received by one or more portions of said side frames.

18. The ambulatory device of claim 17, wherein the support brackets are formed integrally with the seat.

19. The ambulatory device of claim 1, wherein the support brackets are formed integrally with the seat.

20. An ambulatory device-comprising:

(a) two side frames, each side frame including a front and back leg;

(b) a brace connecting the front leg of each of said frames;

(c) a seat having front and rear sections, wherein the front section is pivotably mounted to said frames, wherein said seat can be pivoted into at least two positions:

a first position having a substantially horizontal orientation; and a second position having a substantially vertical orientation; and (d) two support brackets comprising a top surface and one or more flanges extending substantially along said top surface and further comprising one or more notches located in said one or more flanges;

wherein said seat further comprises a substantially flat sitting surface and an under-surface comprising a plurality of walled recesses.

21. An ambulatory device, comprising:

(a) two side frames, each side frame including a front and back leg;

(b) a brace connecting the front leg of each of said frames;

(c) a seat having front and rear sections, wherein the front section is pivotably mounted to said frames, wherein said seat can be pivoted into at least two positions:

a first position having a substantially horizontal orientation; and a second position having a substantially vertical orientation; and (d) at least two support brackets, one of which is disposed downwardly on either side of said seat with respect to the first position to secure said seat to said frames when said seat is in said first position; wherein said support brackets provide support for the ambulatory device when said seat is in said first position such that when lateral force is applied to the side frames, the lateral force is distributed along the support brackets and across said seat; wherein said support brackets comprise a top surface and one or more flanges extending substantially along said top surface and one or more notches located in said one or more flanges.

22. An ambulatory device, comprising:

a. a first side frame and a second side frame, each side frame having a front leg and a back leg; and b. a seat pivotally connected to the first side frame front leg and the second side frame front leg, the seat capable of being disposed in a first position oriented substantially horizontally and a second position oriented substantially vertically, and the seat including an undersurface having at least first and second pluralities of intersecting walls that, while the seat is in the first position, extend downward from the seat undersurface defining a plurality of downward openings;

wherein the seat, while in the first position, has a forward edge that curves inward and a rearward edge that curves inward, causing the seat to narrow in a central region thereof.

23. The ambulatory device according to claim 22 wherein the walls in the first and second pluralities of walls are formed integrally with the seat undersurface.

24. The ambulatory device according to claim 22 wherein the walls in the first plurality of walls are substantially parallel to each other and the walls in the second plurality of walls are substantially parallel to each other.

25. The ambulatory device according to claim 22 wherein the walls in the first plurality of walls are substantially parallel to each other and the walls in the second plurality of walls are substantially parallel to each other, and the first and second pluralities of walls are substantially perpendicular to each other.

26. The ambulatory device according to claim 22 wherein the walls in the first plurality of walls are substantially parallel to each other and the walls in the second plurality of walls are substantially parallel to each other, and the first and second pluralities of walls are substantially perpendicular to each other so that some of the downward openings are substantially rectangular when viewed from below.

27. An ambulatory device, comprising:

a. a first side frame and a second side frame, each side frame having a front leg and a back leg;

b. a seat pivotally connected to the first side frame front leg and the second side frame front leg, the seat capable of being disposed in a first position oriented substantially horizontally and a second position oriented substantially vertically; and c. a first support flange attached to the first side frame front leg and a second support flange attached to the second side frame front leg, each support flange extending inwardly and capable of providing additional support to the seat when the seat is disposed in the first position.

28. The ambulatory device according to claim 27 wherein the seat is pivotally connected to the first side frame front leg by a first pivot bracket extending from the first side frame front leg, wherein the first support flange extends from the first pivot bracket, wherein the seat is pivotally connected to the second side frame front leg by a second pivot bracket extending from the second side frame front leg, and wherein the second support flange extends from the second pivot bracket.

29. The ambulatory device of claim 28, wherein each pivot bracket comprises an angled bracket.

30. The ambulatory device of claim 28, wherein each pivot bracket extends forward of the respective side frame front leg and the corresponding support flange extends substantially perpendicular to and inward from the respective pivot bracket.

31. The ambulatory device of claim 27, further comprising two support brackets disposed to secure the seat to the frames when the seat is in the first position; wherein the support brackets provide support for the ambulatory device when the seat is in the first position such that when lateral force is applied to the side frames, the lateral force is distributed along the support brackets and across the seat.

32. The ambulatory device of claim 31, wherein the support brackets comprise a top surface and one or more flanges extending substantially along the top surface.

33. The ambulatory device of claim 32, wherein the support brackets further comprise one or more notches located in the one or more flanges.

34. The ambulatory device of claim 33, wherein the notches are capable of being received by one or more portions of the side frames.

35. The ambulatory device of claim 27, further comprising two support brackets disposed to secure the seat to said frames when said seat is in said first position.

36. The ambulatory device of claim 35, wherein the support brackets comprise a top surface and one or more flanges extending substantially along said top surface.

37. The ambulatory device of claim 36, wherein the support brackets further comprise one or more notches located in the one or more flanges.

38. The ambulatory device of claim 37, wherein the notches are capable of being received by one or more portions of the side frames.

39. The ambulatory device of claim 27, further comprising at least two downwardly curving support brackets, each downwardly curving support bracket extending outwardly from the seat to engage a respective one of a cross bar between the front leg and the second back leg of one of the side frames, each support bracket including at least first and second support walls that are spaced from each other and that, while the seat is in the first position, extend downward to form at least one downward opening support recess, and wherein at least the first and second support walls each have a substantially inverted-U-shaped recess that, while the seat is in the first position, accepts the respective cross bar for support.

40. The ambulatory device of claim 39, wherein at least the first support walls for the downwardly curving support brackets are connected by a first connecting wall extending across the bottom of a seat undersurface to form at least one continuous wall with the respective support walls.

41. The ambulatory device of claim 39, wherein at least the first and second support walls for the downwardly curving support brackets are connected by first and second connecting walls, respectively, the connecting walls extending across the bottom of a seat undersurface to form at least two continuous walls with the respective support walls.

42. The ambulatory device of claim 39, wherein each support bracket includes an upper support surface and at least a third support wall that is spaced from the first and second support walls that, while the seat is in the first position, extends downward from the upper support surface and cooperates with the first and second support walls to form at least two downward opening support recesses, and wherein the third support wall has a substantially inverted-U-shaped recess that, while the seat is in the first position, accepts the respective cross bar.

43. The ambulatory device of claim 27, wherein each support flange comprises an angle bracket.

44. The ambulatory device of claim 27, wherein at least a portion of each support flange extends substantially horizontally inwardly from the respective side frame front leg.

45. The ambulatory device of claim 27, wherein at least a portion of each support flange is disposed beneath a portion of the seat when the seat is in the first position.

46. The ambulatory device of claim 27, wherein at least a portion of each support flange is capable of engaging a portion of an undersurface of the seat when the seat is in the first position.

47. The ambulatory device of claim 27, wherein each support flange comprises at least one projection extending inwardly from the respective side frame front leg.

48. The ambulatory device of claim 27, wherein each support flange comprises a substantially flat projection extending inwardly from the respective side frame front leg.

49. The ambulatory device of claim 27, wherein each support flange comprises a substantially rectangular projection extending inwardly from the respective side frame front leg.

50. An ambulatory device, comprising:

a. a first side frame and a second side frame, each side frame having a front leg, a back leg, and a cross bar between the front leg and the back leg;

b. a seat pivotally connected to the first side frame front leg and the second side frame front leg, the seat capable of being disposed in a first position oriented substantially horizontally and a second position oriented substantially vertically; and c. at least two downwardly curving support brackets, each downwardly curving support bracket extending outwardly from the seat to engage a respective one of the cross bars of one of the side frames, each support bracket including at least first and second support walls that are spaced from each other and that, while the seat is in the first position, extend downward to form at least one downward opening support recess, and wherein at least the first and second support walls each have a substantially inverted-U-shaped recess that, while the seat is in the first position, accepts the respective cross bar for support.

51. The ambulatory device according to claim 50 wherein the at least two downwardly curving support brackets are formed integrally with the seat.

52. The ambulatory device according to claim 50 wherein the inverted-U-shaped recess is deep enough to accept substantially all of the respective cross bar.

53. The ambulatory device according to claim 50 wherein at least the first support walls for the downwardly curving support brackets are connected by a first connecting wall extending across the bottom of a seat undersurface to form at least one continuous wall with the respective support walls.

54. The ambulatory device according to claim 50 wherein at least the first and second support walls for the downwardly curving support brackets are connected by first and second connecting walls, respectively, the connecting walls extending across the bottom of a seat undersurface to form at least two continuous walls with the respective support walls.

55. The ambulatory device according to claim 50 wherein each support bracket includes an upper support surface and at least a third support wall that is spaced from the first and second support walls that, while the seat is in the first position, extends downward from the upper support surface and cooperates with the first and second support walls to form at least two downward opening support recesses, and wherein the third support wall has a substantially inverted-U-shaped recess that, while the seat is in the first position, accepts the respective cross bar.

56. The ambulatory device according to claim 55 wherein at least the first, second, and third support walls for the downwardly curving support brackets are connected by first, second, and third connecting walls, respectively, the connecting walls extending across the bottom of a seat undersurface to form at least three continuous walls with the respective support walls.

57. The ambulatory device of claim 50, further comprising a first support flange attached to the first side frame front leg and a second support flange attached to the second side frame front leg, each support flange extending inwardly and capable of providing additional support to the seat when the seat is disposed in the first position.

58. The ambulatory device of claim 57, wherein the seat is pivotally connected to the first side frame front leg by a first pivot bracket extending from the first side frame front leg, wherein the first support flange extends from the first pivot bracket, wherein the seat is pivotally connected to the second side frame front leg by a second pivot bracket extending from the second side frame front leg, and wherein the second support flange extends from the second pivot bracket.

59. An ambulatory device, comprising:

a. a first side frame and a second side frame, each side frame having a front leg, a back leg, and a cross bar between the front leg and the back leg;

b. a seat pivotally connected to the first side frame front leg and the second side frame front leg, the seat capable of being disposed in a first position oriented substantially horizontally and a second position oriented substantially vertically;

c. at least two downwardly curving support brackets, each downwardly curving support bracket extending outwardly from the seat to engage a respective one of the cross bars of one of the side frames; and d. at least a first continuous wall extending from one support bracket, under the seat, and to another support bracket, and that, while the seat is in the first position, extends downward from a seat undersurface;

wherein the seat, while in the first position, has a forward edge that curves inward and a rearward edge that curves inward, causing the seat to narrow in a central region thereof.

60. The ambulatory device according to claim 59, further comprising at least a second continuous wall extending from one support bracket, under the seat, and to another support bracket substantially parallel to the first continuous wall, and that, while the seat is in the first position, extends downward from a seat undersurface and cooperates with the first continuous wall to form at least one downward opening.

61. The ambulatory device according to claim 59 further comprising at least second and third continuous walls extending from one support bracket, under the seat, and to another support bracket substantially parallel to the first continuous wall, and that, while the seat is in the first position, extend downward from a seat undersurface and cooperate with the first continuous wall to form at least two downward openings.

62. An ambulatory device, comprising:

a. a first side frame and a second side frame, each side frame having a front leg, a back leg, and a cross bar between the front leg and the back leg;

b. a seat pivotally connected to the first side frame front leg and the second side frame front leg, the seat capable of being disposed in a first position oriented substantially horizontally and a second position oriented substantially vertically; and c. at least two downwardly curving support brackets, each downwardly curving support bracket extending outwardly from the seat to engage a respective one of the cross bars of one of the side frames; and d. wherein said seat further comprises a substantially flat sitting surface and an under-surface and further wherein, while the seat is in the first position, the seat undersurface and at least two downwardly curving support brackets each have at least one downward facing walled opening.

63. The ambulatory device of claim 62, further comprising a first support flange attached to the first side frame front leg and a second support flange attached to the second side frame front leg, each support flange extending inwardly and capable of providing additional support to the seat when the seat is disposed in the first position.

64. The ambulatory device of claim 63, wherein the seat is pivotally connected to the first side frame front leg by a first pivot bracket extending from the first side frame front leg, wherein the first support flange extends from the first pivot bracket, wherein the seat is pivotally connected to the second side frame front leg by a second pivot bracket extending from the second side frame front leg, and wherein the second support flange extends from the second pivot bracket.

65. The ambulatory device of claim 62, wherein the support brackets are formed integrally with the seat.

66. The ambulatory device of claim 62, further comprising at least two downwardly curving support brackets, each downwardly curving support bracket extending outwardly from the seat to engage a respective one of a cross bar between the front leg and the second back leg of one of the side frames, each support bracket including at least first and second support walls that are spaced from each other and that, while the seat is in the first position, extend downward to form at least one downward opening support recess, and wherein at least the first and second support walls each have a substantially inverted-U-shaped recess that, while the seat is in the first position, accepts the respective cross bar for support.

67. The ambulatory device of claim 66, wherein at least the first support walls for the downwardly curving support brackets are connected by a first connecting wall extending across the bottom of a seat undersurface to form at least one continuous wall with the respective support walls.

68. The ambulatory device of claim 66, wherein at least the first and second support walls for the downwardly curving support brackets are connected by first and second connecting walls, respectively, the connecting walls extending across the bottom of a seat undersurface to form at least two continuous walls with the respective support walls.

69. The ambulatory device of claim 66, wherein each support bracket includes an upper support surface and at least a third support wall that is spaced from the first and second support walls that, while the seat is in the first position, extends downward from the upper support surface and cooperates with the first and second support walls to form at least two downward opening support recesses, and wherein the third support wall has a substantially inverted-U-shaped recess that, while the seat is in the first position, accepts the respective cross bar.

70. An ambulatory device, comprising:

a. a first side frame and a second side frame, each side frame having a front leg and a back leg, and a cross bar between the front leg and the back leg;

b. a seat pivotally connected to the first side frame front leg and the second side frame front leg, the seat capable of being disposed in a first position oriented substantially horizontally and a second position oriented substantially vertically, and the seat including an undersurface having first and second pluralities of intersecting walls that, while the seat is in the first position, extend downward from the seat undersurface defining a plurality of downward openings;

c. a first support flange attached to the first side frame front leg and a second support flange attached to the second side frame front leg, each support flange extending inwardly and capable of providing additional support to the seat when the seat is disposed in the first position; and d. at least two downwardly curving support brackets, each downwardly curving support bracket extending outwardly from the seat to engage a respective one of the cross bars of one of the side frames, each support bracket including at least first and second support walls that are spaced from each other and that, while the seat is in the first position, extend downward to form at least one downward opening support recess, and wherein at least the first and second support walls each have a substantially inverted-U-shaped recess that, while the seat is in the first position, accepts the respective cross bar for support.

71. The ambulatory device according to claim 70:

a. wherein the walls in the first plurality of walls are substantially parallel to each other and the walls in the second plurality of walls are substantially parallel to each other, and the first and second pluralities of walls are substantially perpendicular to each other;

b. wherein the seat is pivotally connected to the first side frame front leg by a first pivot bracket extending from the first side frame front leg, wherein the first support flange extends from the first pivot bracket, wherein the seat is pivotally connected to the second side frame front leg by a second pivot bracket extending from the second side frame front leg, and wherein the second support flange extends from the second pivot bracket;

c. wherein each support bracket includes an upper support surface and at least a third support wall that is spaced from the first and second support walls that, while the seat is in the first position, extends downward from the upper support surface and cooperates with the first and second support walls to form at least two downward opening support recesses, and wherein the third support wall has a substantially inverted-U-shaped recess that, while the seat is in the first position, accepts the respective cross bar; and d. wherein at least the first, second, and third support walls for the downwardly curving support brackets are connected by first, second, and third connecting walls, respectively, the connecting walls extending across the bottom of a seat undersurface to form at least three continuous walls with the respective support walls.

72. The ambulatory device according to any of claims 27, 50, 62, 70, or 71 wherein the seat, while in the first position, has a forward edge that curves inward and a rearward edge that curves inward, causing the seat to narrow in a central region thereof.

73. The ambulatory device according to any of claims 50, 59, 62, 70, or 71 wherein the downwardly curving support brackets, while the seat is in the first position, rest on a central region of the respective cross bar.

74. A rollator comprising:

a. a first side frame and a second side frame, each side frame arranged substantially vertically during use of the rollator, each side frame comprising:

(1) a vertically adjustable front leg and a vertically adjustable back leg, (2) a cross bar connecting the front leg and the back leg, (3) an integral transverse horizontal support member between the front leg and the back leg, (4) a wheel disposed on an end of each leg such that the rollator is capable of rolling on a surface on four wheels, (5) an armrest disposed on the horizontal support member, (6) a pivot bracket mounted on the front leg and extending forward of the front leg;

(7) a support flange extending inwardly relative to the front leg;

b. a braking mechanism associated with each side frame, the braking mechanism comprising:

(1) a brake handle mounted on the horizontal support member, (2) a brake shoe disposed on the back leg and capable of frictional engagement with the wheel at the end of the back leg, (3) a cable for providing communication between the brake handle and the brake shoe;

c. a front brace connecting the front leg of each side frame, the front brace comprising:

(1) a first bushing through which the first side frame front leg extends and a second bushing through which the second side frame front leg extends, (2) a curved tubular member joining the first bushing and the second bushing;

d. a molded plastic seat capable of being disposed in a first position oriented substantially horizontally and a second position oriented substantially vertically, the seat comprising:

(1) a seat platform pivotally connected to the pivot brackets of the first and second side frames, the seat platform capable of engaging the support flanges when disposed in the first position, the seat platform comprising:

(i) a top seating surface, (ii) an undersurface having first and second pluralities of intersecting walls that, while the seat is in the first position, extend downward from the seat undersurface to form a plurality of downward openings, (2) at least two integral downwardly curving support brackets, each downwardly curving support bracket extending outwardly from the seat to engage a respective one of the cross bars of one of the side frames, each support bracket including at least first and second support walls that are spaced from each other and that, while the seat is in the first position, extend downward to form at least one downward opening support recess, and wherein at least the first and second support walls each have a substantially inverted-U-shaped recess that, while the seat is in the first position, accepts the respective cross bar for support; and e. a flexible back support extending between the first side frame front leg and the second side frame front leg and above the front brace;

wherein each side frame is pivotable relative to the front brace by pivotable movement of the front legs in the first and second bushings and wherein the axis of rotation of the seat about the pivot brackets is offset forward of the front legs by at least the depth of the seat platform.

75. The ambulatory device according to claim 74:

a. wherein the walls in the first plurality of walls are substantially parallel to each other and the walls in the second plurality of walls are substantially parallel to each other, and the first and second pluralities of walls are substantially perpendicular to each other;

b. wherein the first support flange extends from the first pivot bracket and the second support flange extends from the second pivot bracket;

c. wherein each support bracket includes an upper support surface and at least a third support wall that is spaced from the first and second support walls that, while the seat is in the first position, extends downward from the upper support surface and cooperates with the first and second support walls to form at least two downward opening support recesses, and wherein the third support wall has a substantially inverted-U-shaped recess that, while the seat is in the first position, accepts the respective cross bar; and d. wherein at least the first, second, and third support walls for the downwardly curving support brackets are connected by first, second, and third connecting walls, respectively, the connecting walls extending across the bottom of a seat undersurface to form at least three continuous walls with the respective support walls.

* * * * *